US005938512A

United States Patent [19]

Takei et al.

[11] Patent Number: 5,938,512

[45] Date of Patent: Aug. 17, 1999

[54] WAFER HOLDING JIG

[75] Inventors: Tokio Takei; Susumu Nakamura, both of Nagano, Japan

[73] Assignee: Shin-Etsu Handotai Co., Ltd., Tokyo, Japan

[21] Appl. No.: 08/991,492

[22] Filed: Dec. 16, 1997

[30] Foreign Application Priority Data

Dec. 27, 1996 [JP] Japan ..... 8-357981

[51] Int. Cl.[6] ..... B24B 7/22; B24B 41/06

[52] U.S. Cl. ..... 451/388; 451/289

[58] Field of Search ..... 451/388, 288, 451/41, 398; 269/21

[56] References Cited

U.S. PATENT DOCUMENTS

| | | | |
|---|---|---|---|
| 3,731,435 | 5/1973 | Boettcher et al. | 451/388 |
| 4,521,995 | 6/1985 | Sekiya | 451/388 |
| 4,597,228 | 7/1986 | Koyama et al. | 451/388 |
| 5,645,474 | 7/1997 | Kubo et al. | 451/388 |

FOREIGN PATENT DOCUMENTS

| | | | |
|---|---|---|---|
| 776730A1 | 6/1997 | European Pat. Off. . | |
| 8180026 | 10/1983 | Japan | 451/388 |

*Primary Examiner*—Robert A. Rose
*Attorney, Agent, or Firm*—Loeb & Loeb LLP

[57] ABSTRACT

There is disclosed a wafer holding jig having a porous holding surface for vacuum-holding a semiconductor wafer while the wafer is ground or polished. The porosity of a center region of the holding surface is made larger than that of an outside region formed to surround the center region. The outer diameter of the center region is made less than that of the wafer, while the outer diameter of the outside region is made greater than that of the wafer. It is possible to prevent deterioration in machining accuracy, which deterioration would otherwise occur due to deformation of a wafer stemming from catch of dust or the like, or application of machining pressure to the wafer.

9 Claims, 2 Drawing Sheets

WAFER HOLDING JIG

BACKGROUND OF THE INVENTION

1. Field of the Invention

The present invention relates to an improvement on a wafer holding jig for vacuum-holding a semiconductor wafer while the wafer is ground or polished.

2. Description of the Related Art

Conventionally, when a wafer such as a silicon wafer or a GaAs wafer is ground or polished, a wafer holding jig formed from a fine-grain sintered body-which has a high strength and which therefore does not deform due to machining pressure-is used to accurately machine the surface of the wafer into a highly flat surface.

Also, there has been known a holding jig having a plurality of regions having different characters. As shown in FIG. 5, in such a holding jig 51, a wafer holding surface for holding a wafer W is formed by a porous fine-grain sintered body 52 and a nonporous fine-grain sintered body 53 surrounding the porous fine-grain sintered body 52. The porous fine-grain sintered body 52 is formed by a process in which fine grains are sintered such that a resultant sintered body becomes porous. The nonporous fine-grain sintered body 53 is formed by a process in which fine grains are sintered such that a resultant sintered body becomes dense or nonporous. Evacuation passages 54 are formed to communicate with the porous fine-grain sintered body 52. The wafer W is vacuum-held by means of evacuation through the evacuation passages 54. In such a holding jig, in order to define a vacuum region, the outer diameter of the porous fine-grain sintered body 52 is generally made smaller than the diameter of the wafer W, so that the vacuum region is formed by the outside nonporous fine-grain sintered body 53 and the wafer W.

In general, even when the holding surface of a holding jig is flat, a wafer held by the holding jig deforms if foreign matter such as dust is caught between the wafer and the holding surface of the holding jig. This becomes a cause of a deterioration in machining accuracy.

In the case of the above-described vacuum type wafer holding jig, since dust caught between the porous fine-grain sintered body 52 and the wafer W is sucked through pores in the surface of the porous fine-grain sintered body 52, no problems occur. However, since dust caught between the wafer W and the nonporous fine-grain sintered body 53, which holds the outer circumferential portion of the wafer is not sucked, the wafer W may be held in a deformed state.

When the wafer is machined in such a state, the flatness of the surface of the wafer deteriorates.

Further, the amount of deformation of the wafer W due to application of machining pressure varies between the portion held by the porous fine-grain sintered body 52 and the portion held by the nonporous fine-grain sintered body 53. Since the amount of load-induced deformation at the portion held by the fine-grain porous sintered body 52 is greater than that at the portion held by the nonporous fine-grain sintered body 53, the stock removal of the machining (amount of material removed by machining) at the center portion becomes smaller. Therefore, the machined wafer has a problem of insufficient flatness (flatness defect) in which the center portion has a lager thickness than does the remaining portion of the wafer.

Therefore, there has been a strong desire for a technique for preventing a deterioration in machining accuracy, which deterioration would otherwise occur due to deformation of the wafer stemming from catch of dust or the like, or unevenness in deformation generated upon application of machining pressure to the wafer.

SUMMARY OF THE INVENTION

The present invention has been conceived in view of the foregoing drawbacks. An object of the present invention is to provide a wafer holding jig which can prevent deterioration in machining accuracy, which deterioration would otherwise occur due to deformation of a wafer stemming from catch of dust or the like, or unevenness in deformation generated upon application of machining pressure to the wafer.

In order to achieve the above object, the present invention provides a wafer holding jig having a porous holding surface for vacuum-holding a semiconductor wafer while the wafer is ground or polished. The porosity of a center region of the holding surface is made larger than that of an outside region formed to surround the center region, and the outer diameter of the center region is made less than that of the wafer, while the outer diameter of the outside region is made greater than that of the wafer.

Since the outer diameter of the outside region is made greater than that of the wafer in order to hold the entire wafer by the porous surface, unevenness in the amount of deformation of the wafer upon application of pressure can be suppressed. In addition, since foreign matter such as dust is easily sucked through pores at the porous surface, the wafer becomes less likely to deform.

Also, since the outer diameter of the center region is made smaller than that of the wafer, the center region can be utilized as a vacuum region.

Preferably, an evacuation passage is formed to communicate with the center region without communicating with the outside region.

Since the evacuation passage is formed to communicate only with the center region having a large porosity, and evacuation is performed via the evacuation passage, the degree of vacuum in a vacuum region can be increased to thereby improve the holding performance.

Preferably, pores in the center region have an average diameter of 60–300 $\mu$m, and pores in the outside region have an average diameter of 2–50 $\mu$m.

The reason why the average diameter of the pores in the center region is set to fall within the range of 60–300 $\mu$m is that if the average diameter of the pores in the center region falls within the range, the pores of the center region can provide a high performance of sucking dust or the like and reliable evacuation. The reason why the average diameter of the pores in the outside region is set to fall within the range of 2–50 $\mu$m is that if the average diameter of the pores in the outside region falls within the range, the outside region can reliably define a vacuum region and can prevent occurrence of flatness defect during machining. That is, if the average diameter of the pores in the outside region is set to 50 $\mu$m or greater, the vacuum region cannot be defined reliably, resulting in a decrease in the holding force; and if the average diameter of the pores in the outside region is set to 2 $\mu$m or less, the flatness failure increases.

Preferably, the outer diameter of the center region is 50–99% of that of the wafer, and the outer diameter of the outside region is 100–200% of that of the wafer.

When the outer diameter of the center region is set to fall within the above-described range, a sufficient vacuum-holding performance is obtained. When the outer diameter of the outside region is set to fall within the above-described range, the size of the holding jig is prevented from increasing unreasonably.

In the present invention, the holding surface of the wafer holding jig is divided into a center region and an outside region; the porosity of the center region is made larger than that of the outside region; and the outer diameter of the center region is made less than that of a wafer to be held, while the outer diameter of the outside region is made greater than that of the wafer. Therefore, the entire wafer can be held by the porous surface and unevenness in the amount of deformation upon application of machining pressure can be suppressed. In addition, suction of foreign matter such as dust through pores at the porous surface is facilitated. Since adversary effects caused by the unevenness deformation and catch of foreign matter can be eliminated, the wafer becomes less likely to deform, resulting in an increase in machining accuracy.

Further, since an air purification facility for preventing adhesion of foreign matter and a system for cleansing the holding jig becomes unnecessary, the entire facility can be simplified.

DESCRIPTION OF THE PREFERRED EMBODIMENTS

Embodiments of the present invention will be described in detail with reference to the drawings.

A wafer-holding jig according to the present invention is used for holding a brittle wafer, such as a silicon wafer or a GaAs wafer, while the surface of the wafer is ground or polished. The wafer-holding jig is designed to improve the flatness of the wafer through accurate holding thereof.

Figure 1:
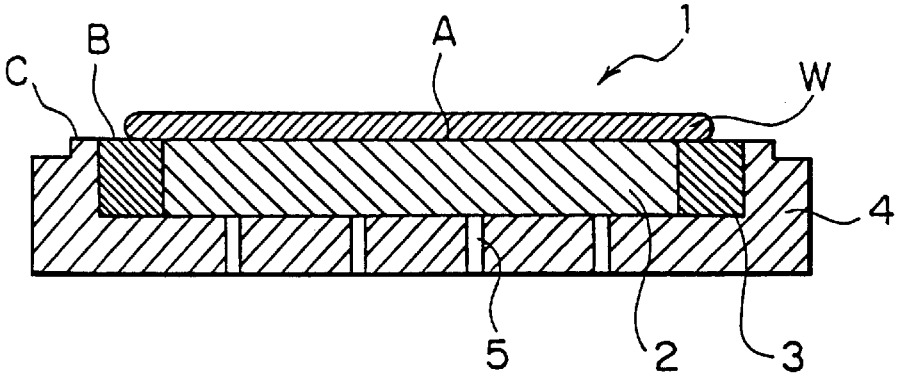
FIG. 1 is a vertical sectional view of a wafer holding jig according to the present invention.

That is, as shown in FIG. 1, the holding surface of the wafer holding jig 1 according to the present invention is divided into concentric annular regions A, B, and C, in this sequence from the center of the holding surface toward the outside. The regions A, B, and C are formed by a first porous fine-grain sintered body 2, a second porous fine-grain sintered body 3, and a nonporous fine-grain sintered body 4, respectively. The porosity of the first porous fine-grain sintered body 2—which forms the center region A—is made different from the porosity of the second porous fine-grain sintered body 3—which forms the outside region B, which is located immediately outside the center region A. The nonporous fine-grain sintered body 4—which forms the outermost region C—is dense or nonporous.

The pores in the center region A have an average diameter of 60–300 $\mu$m in order to provide a relatively large porosity, and the pores in the outside region B have an average diameter of 2–50 $\mu$m in order to provide a porosity smaller than that in the center region A. The outer diameter of the center region A is smaller than that of the wafer W (50–99%), while the outer diameter of the outside region B is greater than that of the wafer W (100–200%).

Evacuation passages 5 serving as vacuum piping are formed in the bottom wall of the nonporous fine-grain sintered body 4 such that the inner ends of the evacuation passages 5 reach the bottom of the first porous fine-grain sintered body 2, which forms the center region A. After a wafer W is placed on the holding jig 1, air in the center region A is evacuated through the evacuation passages 5 in order to vacuum-hold the wafer.

Since the evacuation passages 5 do not reach the outside region B, the degree of vacuum in the center region A can be increased.

Such a vacuum-type holding jig has an advantage that even when dust or the like enters the space between the wafer W and the holding surface of the holding jig, the dust or the like is sucked through pores at the porous surface by means of evacuation in order to prevent the wafer W from deforming due to dust or the like.

In view of the foregoing, the holding jig 1 of the present invention is designed such that the entire wafer W is held by the porous surface in order to fully utilize the advantage of the vacuum-type holding jig.

Further, since the porosity of the center region A is made larger than that of the outside region B outside the center region A, a vacuum zone can be effectively created in the center region A.

In contrast, when the center region A has the same porosity as that of the outside region B, there arises a problem that if the average diameter of the pores is increased, the vacuum zone cannot be formed, resulting in a reduction in the holding force, and if the average diameter of the pores is decreased, the performance for sucking dust or the like deteriorates, which may cause deformation of the wafer W due to dust or the like.

The wafer-holding jig according to the present invention is manufactured by the following method. A dense fine-grain sintered body formed of alumina ceramics and having a very low porosity, which is commercially available, is crushed into grains, which are then divided into a large-grain-size group and a small-grain-size group. The grains of the large-grain-size group are used as material for the first porous fine-grain sintered body, while the grains of the small-grain-size group are used as material for the second porous fine-grain sintered body. Each group of grains is mixed with binder and glass, which serve as adhesive agents, and the mixture is sintered to obtain a sintered body. During the sintering process, the binder and the glass partially evaporate to form pores. Thus, there are manufactured the first and second porous fine-grain sintered bodies which have different porosities due to differences in grain size and sintering conditions. The dense (nonporous) fine-grain sintered body is manufactured according to a conventional manner. Subsequently, the first porous fine-grain sintered body, the second porous fine-grain sintered body, and the dense or nonporous fine-grain sintered body are bonded together through use of fused glass. Finally, the holding surface is mechanically machined into a flat surface, so that the wafer holding jig is completed.

Figure 2:
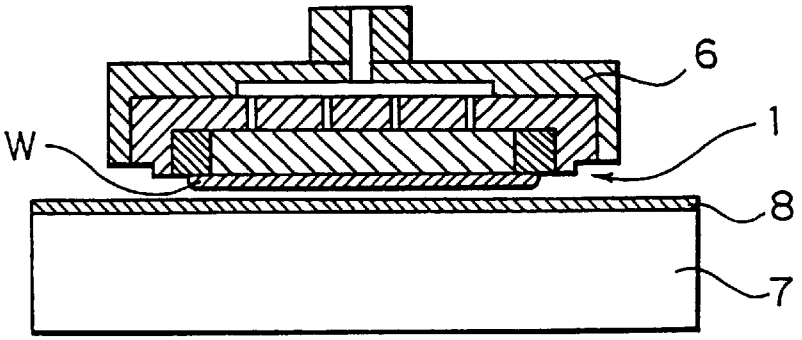
FIG. 2 is an explanatory view showing a case in which the wafer holding jig according to the present invention is used in a polishing process.

FIG. 2 shows an example in which the holding jig 1 according to the present invention is applied to a polishing process.

That is, a wafer W is vacuum-held by the holding jig 1 attached to a polishing head 6, and the wafer W is polished by a polishing pad 8 attached to a polishing table 7. Even when dust or the like enters the space between the holding surface of the holding jig 1 and the wafer W during the polishing process, the dust or the like is sucked and therefore does not cause adversary effect such as deformation of the wafer. Further, even when a machining pressure acts on the wafer W, a difference in deformation amount is not produced between the center region A and the outside region B, so that the flatness of the wafer W is not deteriorated.

Figure 3:
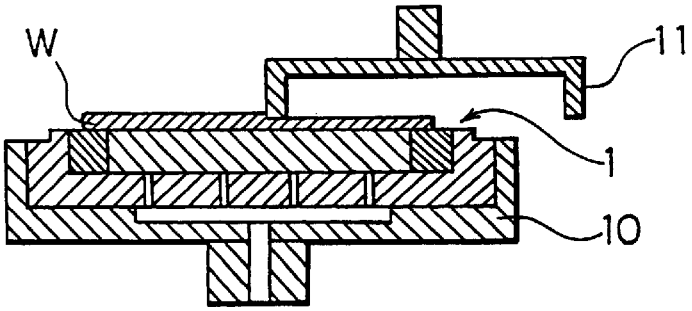
FIG. 3 is an explanatory view showing a case in which the wafer holding jig according to the present invention is used in a grinding process.

FIG. 3 shows an example in which the holding jig 1 according to the present invention is applied to a grinding process.

That is, in this case, a wafer W is vacuum-held by the holding jig 1 attached to a grinding head 10, and the wafer W is ground by a grinding stone 11. In this case as well, the wafer W can be machined to have a highly flat surface.

In both cases, there is an advantage of eliminating the need for an auxiliary facility such as an air purification facility for preventing adhesion of foreign matter or a system for cleansing the holding jig.

EXAMPLES

A holding jig was manufactured such that the center region A had an outer diameter of 130 mm and a pore average diameter of 100 $\mu$m while the outside region B had an outer diameter of 160 mm and a pore average diameter of 10 $\mu$m. A wafer W having a diameter of 150 mm was ground through use of the holding jig (Example). Also, a conventional holding jig was manufactured such that the center porous fine-grain sintered body 52 had an outer diameter of 140 mm and a pore average diameter of 100 $\mu$m while the outside dense (nonporous) fine-grain sintered body 53 had an outer diameter of 160 mm. An identical wafer W was ground through use of the holding jig (Comparative Example).

Figure 4:
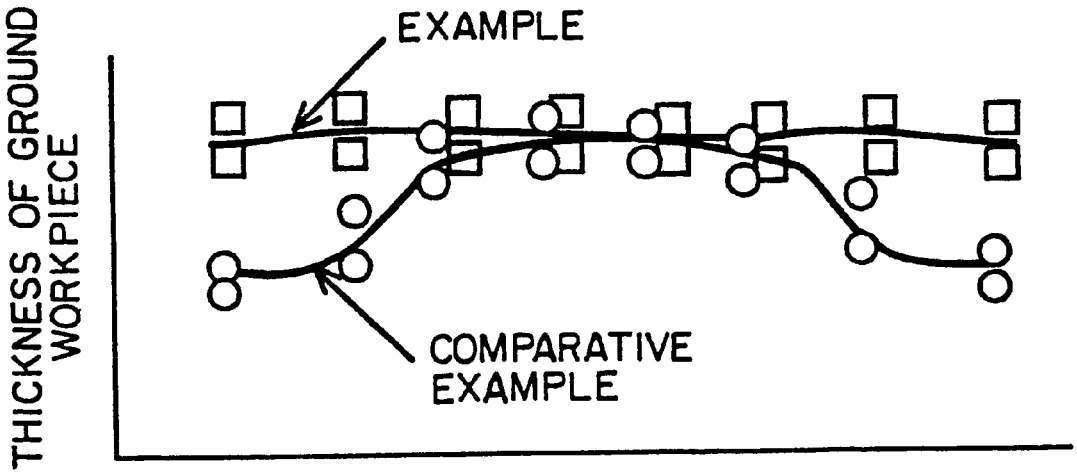
FIG. 4 is a diagram showing the results of grinding tests in which the shape of a wafer ground by a grinding process utilizing the wafer holding jig of the present invention is compared with a wafer ground by a grinding process utilizing a conventional wafer holding jig.
Figure 5:
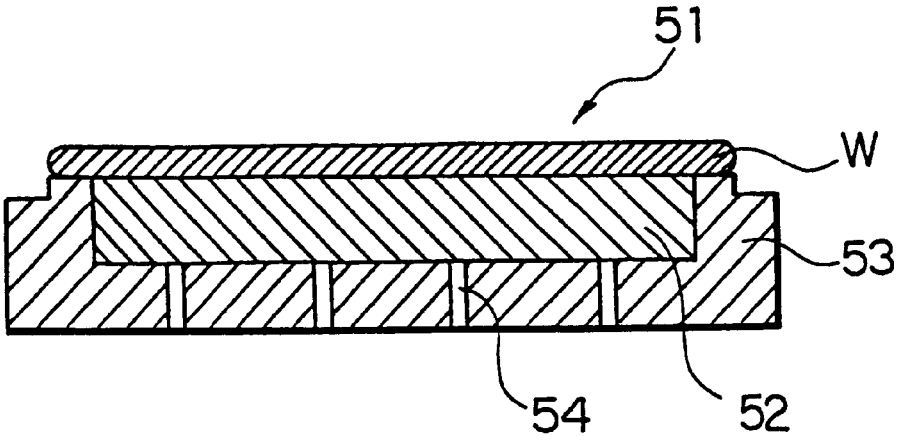
FIG. 5 is a vertical sectional view of a conventional wafer holding jig.

Example utilizing the holding jig of the present invention was compared with Comparative Example utilizing the conventional holding jig, in terms of machining accuracy. As is apparent from FIG. 4, which shows thickness distribution in the ground wafers, when the holding jig of the present invention was used, each wafer was machined to have a highly flat surface without causing a flatness failure. Whereas none of 100 wafers had a flatness failure in Example, 15 of 100 wafers had a flatness failure in Comparative Example.

In the above-described embodiment, the center region A and the outside region B have uniform porosity respectively. However, each of the regions A and B may be divided into subregions in order to change the porosity stepwise. The above-described embodiment is a mere example, and those having the substantially same structure as that described in the appended claims and providing the similar action and effects are included in the scope of the present invention.

What is claimed is:

1. A wafer holding jig having a porous holding surface for vacuum-holding a semiconductor wafer while the wafer is ground or polished, wherein the porosity of a porous center region of the holding surface is made larger than that of a porous outside region formed to surround the center region, and the outer diameter of the center region is made less than that of the wafer, while the outer diameter of the outside region is made greater than that of the wafer.

2. A wafer holding jig according to claim 1, wherein an evacuation passage is formed to communicate with the center region without communicating with the outside region.

3. A wafer holding jig according to claim 1, wherein pores in the center region have an average diameter of 60–300 $\mu$m, and pores in the outside region have an average diameter of 2–50 $\mu$m.

4. A wafer holding jig according to claim 2, wherein pores in the center region have an average diameter of 60–300 $\mu$m, and pores in the outside region have an average diameter of 2–50 $\mu$m.

5. A wafer holding jig according to claim 1, wherein the outer diameter of the center region is 50–99% of that of the wafer, and the outer diameter of the outside region is 100–200% of that of the wafer.

6. A wafer holding jig according to claim 2, wherein the outer diameter of the center region is 50–99% of that of the wafer, and the outer diameter of the outside region is 100–200% of that of the wafer.

7. A wafer holding jig according to claim 3, wherein the outer diameter of the center region is 50–99% of that of the wafer, and the outer diameter of the outside region is 100–200% of that of the wafer.

8. A wafer holding jig according to claim 4, wherein the outer diameter of the center region is 50–99% of that of the wafer, and the outer diameter of the outside region is 100–200% of that of the wafer.

9. A wafer holding jig having a porous holding surface for vacuum-holding a semiconductor wafer while the wafer is ground or polished, wherein the holding surface has a porous center region formed at the center of the holding surface, a porous outside region formed to surround the center region and having a porosity smaller than that of the center region, and a substantially nonporous outermost region formed to surround the outside region; and the outer diameter of the center region is made less than that of the wafer, while the outer diameter of the outside region is made greater than that of the wafer.

* * * * *